United States Patent [19]

Mulkey et al.

[11] 4,073,249

[45] Feb. 14, 1977

[54] ATTACHMENT FOR SEWING MACHINES AND A METHOD OF MAKING OVERLAPPED STITCHES

[76] Inventors: Dennis A. Mulkey; C. Kepler Brown, Jr., both of Richmond, Va.

[21] Appl. No.: 680,862

[22] Filed: Apr. 27, 1976

[51] Int. Cl.[2] ..... D05B 27/04

[52] U.S. Cl. ..... 112/212; 112/77; 112/158 B

[58] Field of Search ..... 112/212, 203, 98, 102, 112/103, 77, 158 B, 158 R, 135, 210

[56] References Cited

U.S. PATENT DOCUMENTS

| | | | |
|---|---|---|---|
| 1,474,966 | 11/1923 | Hayes | 112/212 |
| 2,504,069 | 4/1950 | Enos | 112/77 |
| 2,653,557 | 9/1953 | Casas-Robert et al. | 112/98 |
| 3,014,444 | 12/1961 | Caldwell | 112/135 |
| 3,580,199 | 5/1971 | Vigorelli | 112/158 R |
| 3,730,117 | 5/1973 | Ritter et al. | 112/212 |

*Primary Examiner*—H. Hampton Hunter

*Attorney, Agent, or Firm*—Sherman & Shalloway

[57] ABSTRACT

An attachment for sewing machines allows any sewing machine to stitch double-knit and other stretch fabrics properly by overlapping three stitches before making a successive stitch in a line of stitches. The attachment includes a mounting bar which is secured to an accessory bar on the sewing machine and a first lever pivoted on the mounting bar which oscillates as the needle of the sewing machine reciprocates. A second lever, with fabric engaging reverse feed dogs, is also pivoted on the mounting bar, and is rotated by the first lever through a ratchet mechanism, which allows the first lever to engage and rotate the second lever every third stitch. Upon rotation, the second lever moves the reverse feed dogs into engagement with the fabric to push the fabric in the reverse direction a length of one stitch. When the operation of this attachment is coordinated with existing bottom feed dogs on the sewing machine, three overlapped stitches are made for each one-stitch advance of the fabric.

17 Claims, 13 Drawing Figures

ATTACHMENT FOR SEWING MACHINES AND A METHOD OF MAKING OVERLAPPED STITCHES

BACKGROUND OF THE INVENTION

1. Field of the Invention

This invention relates to attachments for sewing machines, and more particularly to an attachment for sewing machines which converts standard sewing machines to stitch double-knit fabrics.

2. Technical Considerations and Prior Art

When stitching double-knit fabrics, it is necessary to overlap each stitch three times before proceeding to the next stitch. This is, usually, accomplished by advancing the fabric forward to form a first leg of the stitch; reversing the fabric one-stitch length to form a second leg of the stitch and then advancing the fabric forward two-stitch lengths to complete the initial stitch with three overlaps and form the first leg of the next stitch. This procedure is necessary with double-knit fabrics, because double-knit fabrics stretch and thus transfer any force applied to the fabric directly to seams in the fabric. Consequently, seams in double-knit fabrics need to be much stronger than seams utilized in other types of fabric which have structures that absorbs much of the force applied to the fabric.

There are sewing machines currently available which will make the above-described overlapped stitch, however, these machines are relatively expensive and cannot make this stitch in many of the desired configurations such as "satin stitch configurations".

In view of the increasing popularity of double-knit fabrics, there is a need for an attachment which will give any sewing machine the capability of making the overlapped stitch for double-knit fabrics. In order to gain wide acceptance of such an attachment, it is necessary for the attachment to adapt readily to any sewing machine with a minimum of adjustment, and to operate without requiring any change in habit on the part of the user or operator. The prior art does not provide such an attachment.

OBJECTS OF THE INVENTION

In view of the deficiencies of the prior art, it is an object of the invention to provide a new and improved attachment for sewing machines, which enables sewing machines to make overlapped stitches necessary in sewing double-knit fabrics and/or any other stretchable fabric and any fabric which needs extra strength stitching.

It is a further object of the instant invention to provide a new and improved attachment for sewing machines for making overlapped stitches, wherein the attachment is readily adaptable to any machine currently available in the market place or currently used.

It is still an additional object of the instant invention to provide an attachment of the afore-described type, which is relatively inexpensive to manufacture.

It is still an additional object of the instant invention to provide a new and improved attachment of the afore-described type, which is readily and easily attachable to the various sewing machines currently available in the market place or in use.

It is still another object of the instant invention to provide a new and improved attachment of the above-described type, which allows existing machines to perform the afore-described stitch for knitted fabrics in any of the configurations available with current machines, so that stitches with various patterns and various lengths are obtainable.

It is still a further object of the instant invention to provide an attachment of the afore-described type which does not alter the interior function of the sewing machine to which it is attached.

SUMMARY OF THE INVENTION

With these and other objects in mind, the instant invention contemplates both a method for stitching fabric and an attachment for performing the method. Generally, the method involves advancing the fabric a length of one stitch with feed dogs disposed beneath the fabric, and then reversing the fabric a length of one stitch with a reverse dog disposed above the fabric. A second stitch is then made, and the fabric is, in effect, advanced a length of two stitches in the first direction before being again reversed.

An apparatus, according to the instant invention, contemplates an attachment which has a mounting member with means thereon for rigidly securing the mounting member to a sewing machine. A first lever is pivoted on the mounting member and coupled at one end to oscillate, as the needle of the machine reciprocates. A pawl means is mounted on the first lever, and engages a ratchet to index one step with each cycle of the first lever. Each step of the ratchet corresponds to forming one stitch with the needle. The displacement of the pawl is altered every third step, or rather after each two-step advance of the ratchet, so as to engage and move a second lever means which, in turn, reverses the direction of fabric advance for one stitch, so that as a line of stitches is formed, each stitch will overlap itself three times.

Figure 4:
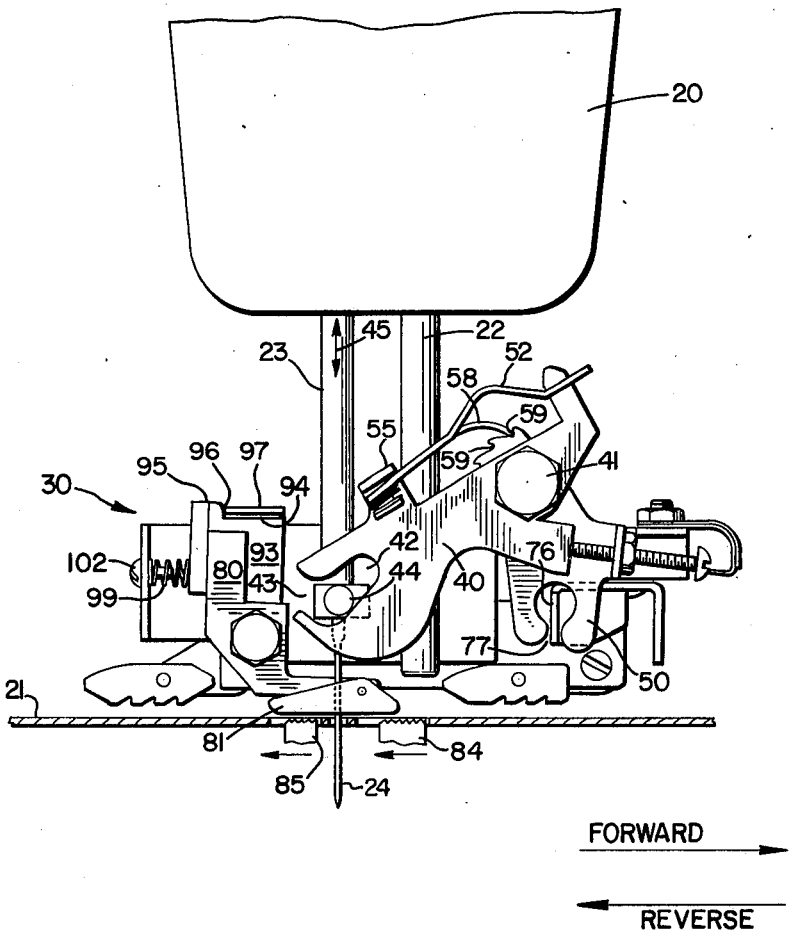
FIG. 4 is a side view showing a needle of the sewing machine penetrating the fabric just prior to advancing the fabric in its normal direction of advance.
Figure 7:
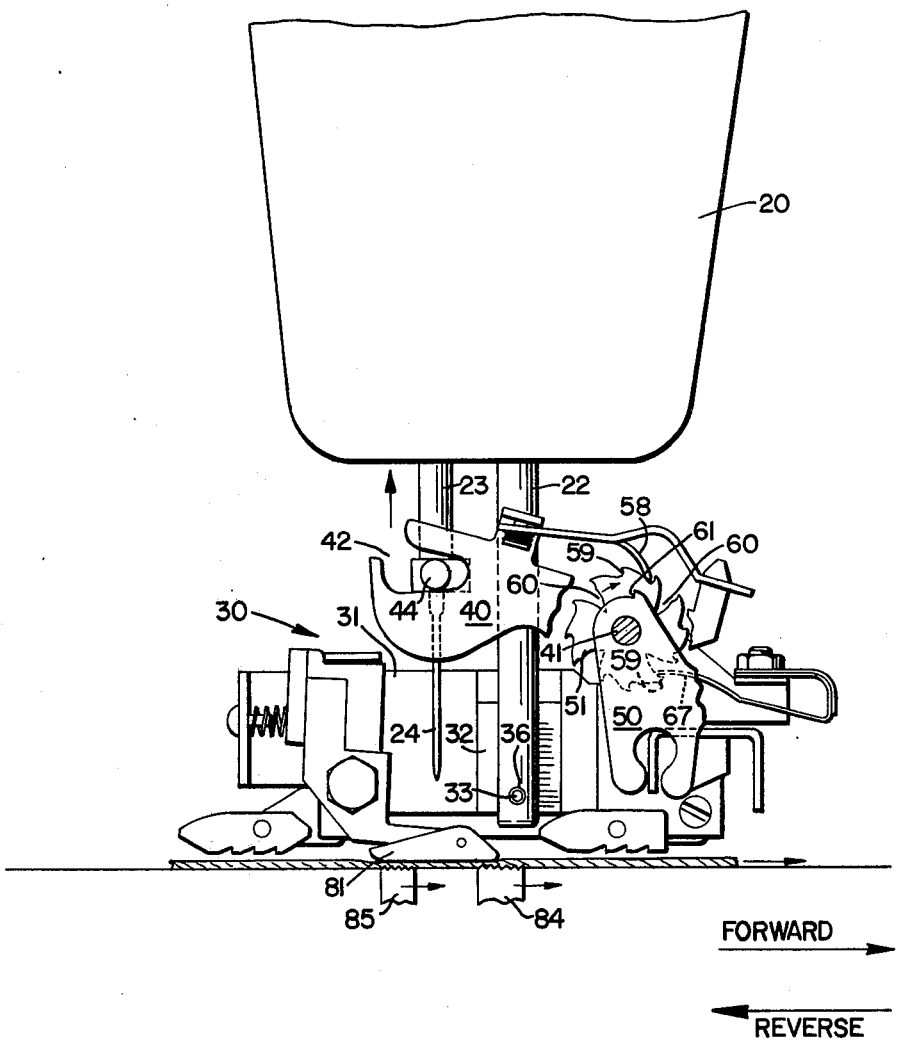
FIG. 7 is a end view showing the side of the attachment of FIGS. 4 and 5, but showing the needle being retracted from the fabric, and the fabric advancing in the normal direction of advance.
Figure 7A:
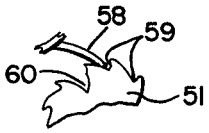
Figure 8:
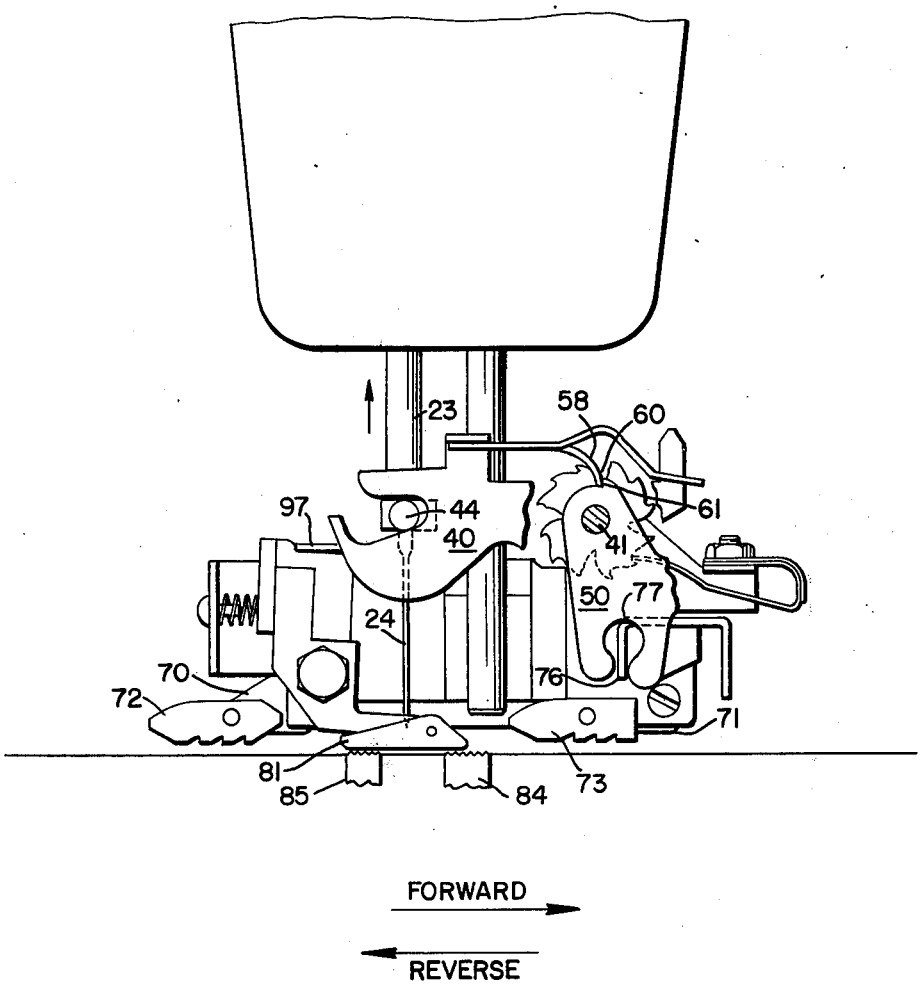
Figure 9:
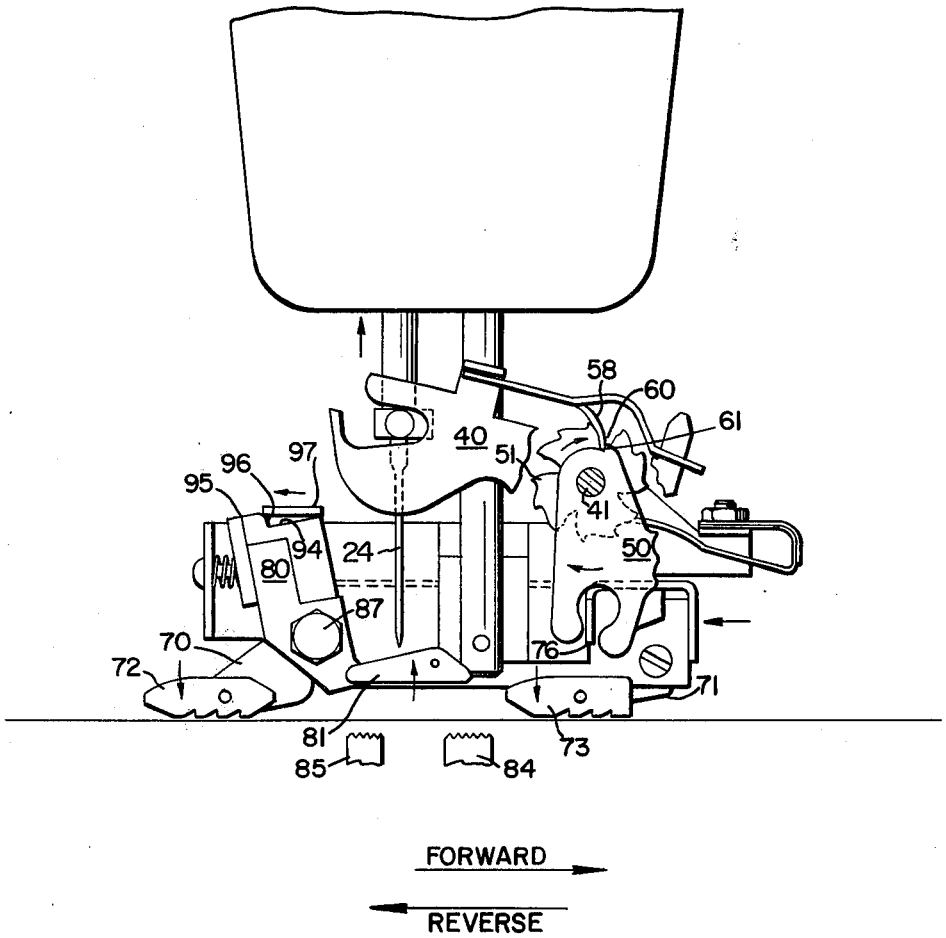
Figure 10:
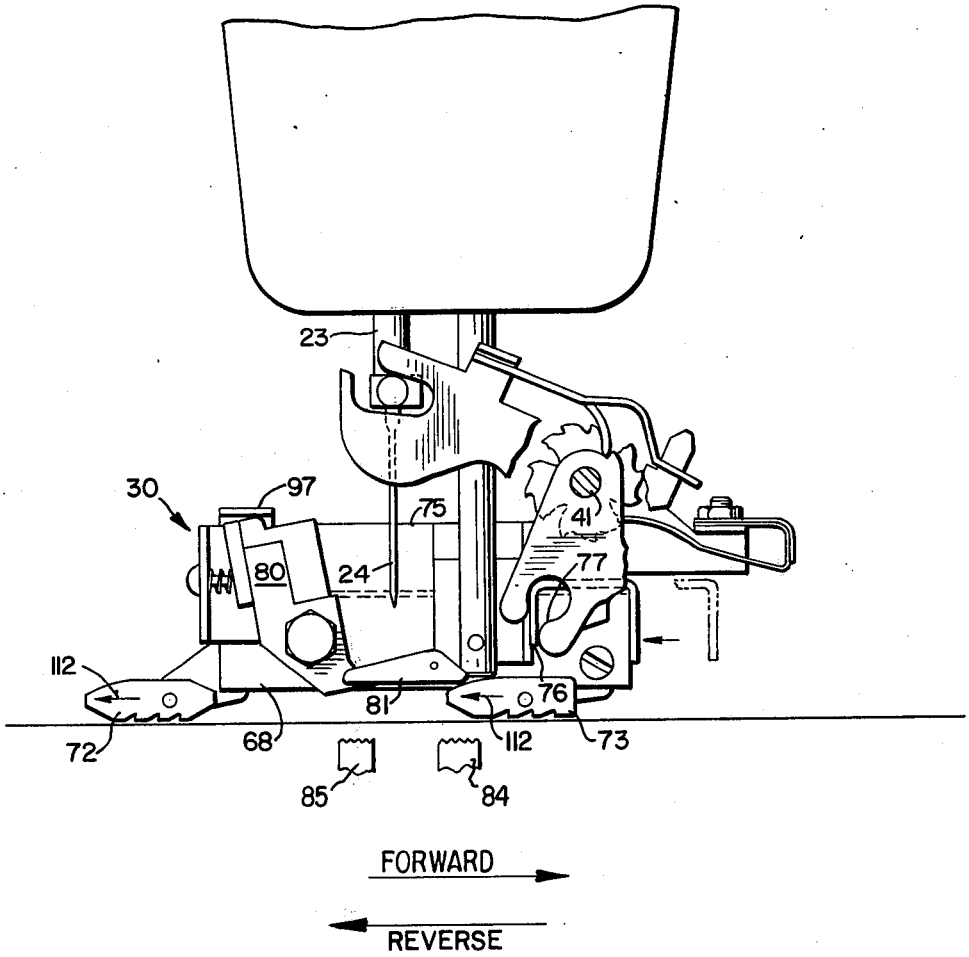
Figure 11:
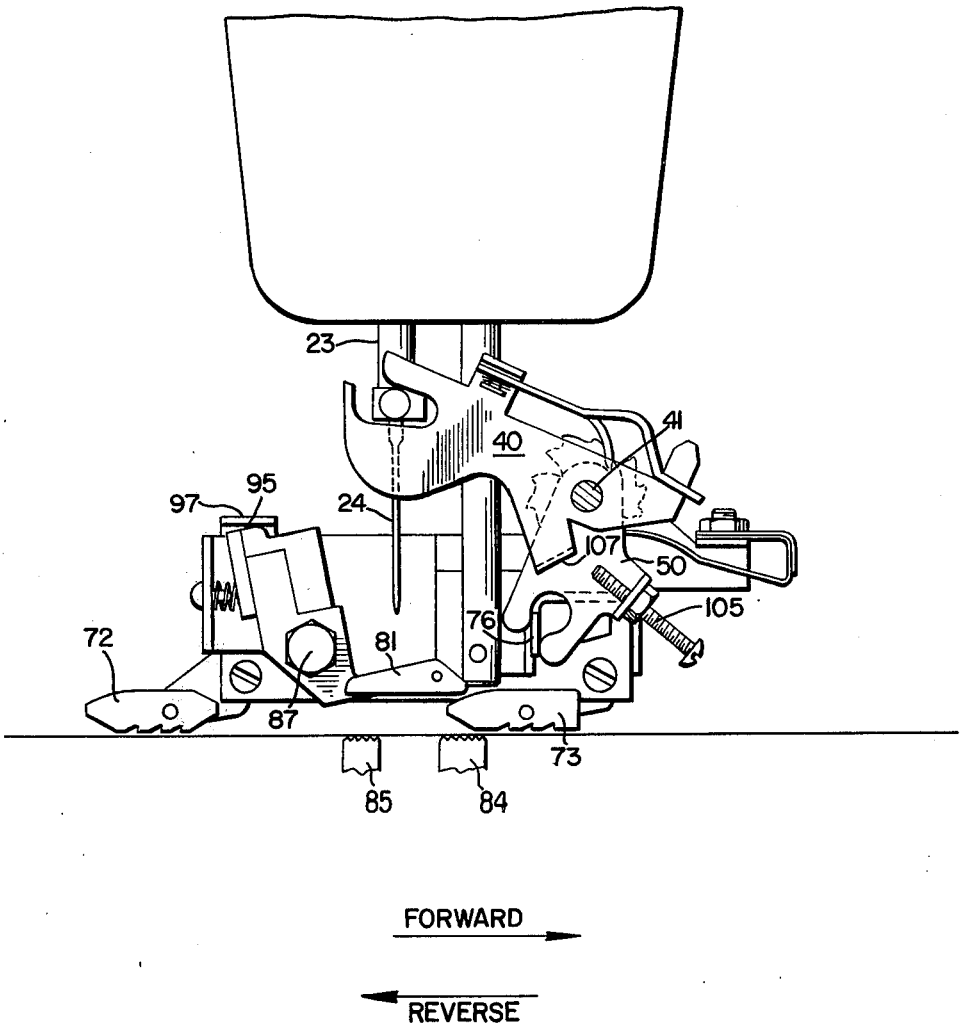

FIG. *7a* is a view of the pawl and ratchet with parts broken away;

FIG. 8 is a side view showing a pawl dropping into a deep slot in a ratchet, in order to activate a fabric reversing mechanism associated with the attachment;

FIG. 9 is an end view showing the reversing mechanism lowering reverse feed dogs and lifting a pressure foot just prior to reversing the direction of the fabric advance;

FIG. 10 is an end view showing the reverse feed dogs moving opposite the direction of fabric advance illustrated in FIG. 7; and FIG. 11 illustrates the end of the reversal operation, which precludes a return to the condition of FIG. 4.

DETAILED DESCRIPTION

In order to properly stitch stretch-type fabrics, such as double-knit fabrics, in which stress is transferred to a stitch through the fabric, because the fabric tends to stretch, or is elastic, it is necessary to overlap each stitch. This is accomplished by advancing the fabric two-stitch lengths in one direction, hereinafter referred to as the forward direction, and then reversing the fabric one-stitch length before again advancing the fabric two-stitch lengths. With each stitch advance and each stitch reversal, a single stitch is made, so that for each stitch length there will be three overlapped stitches.

Figure 1:
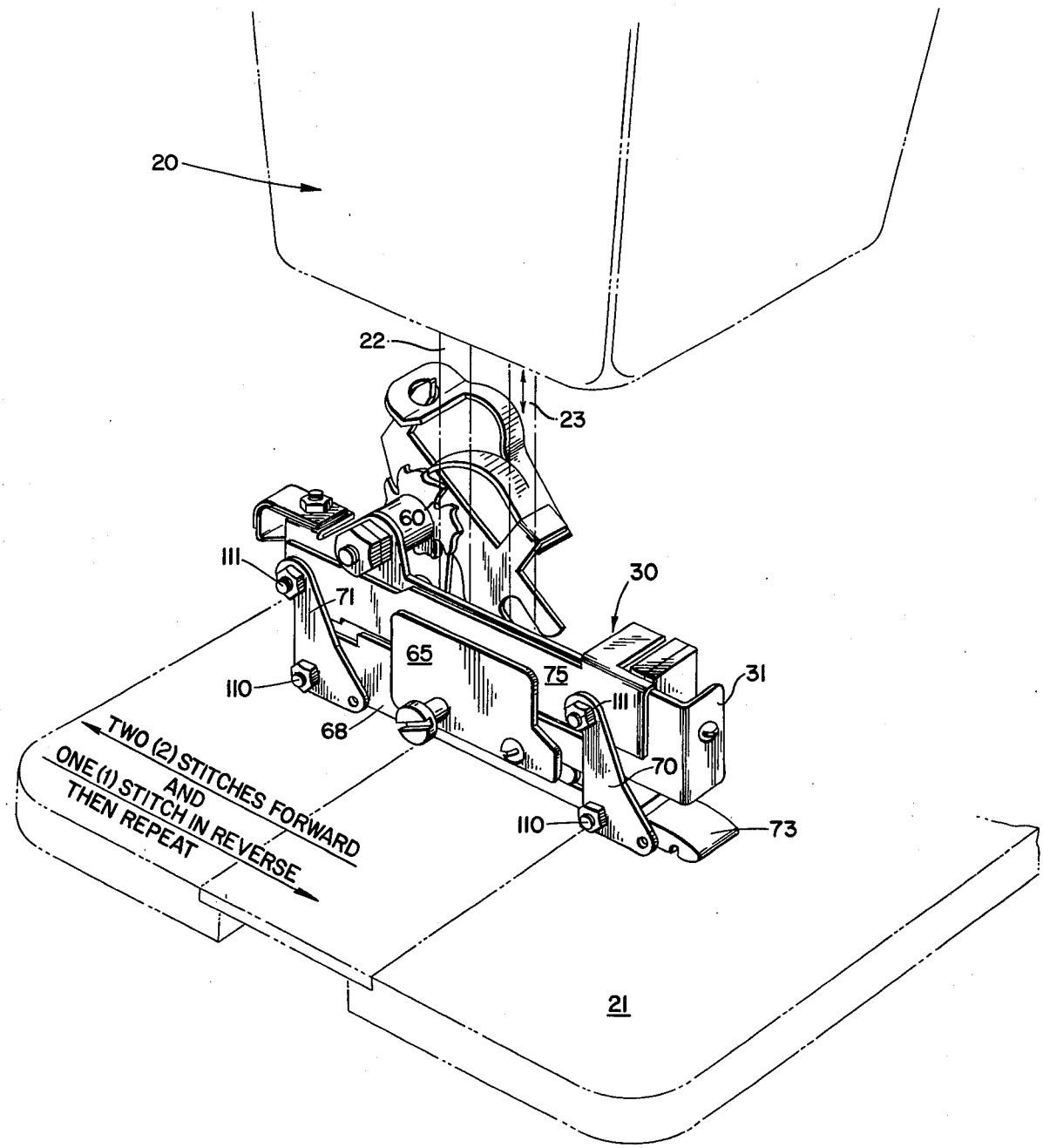
FIG. 1 is an isometric view of the attachment, according to the invention, mounted on a sewing machine.

Referring now to FIG. 1, there is shown a sewing machine, designated generally by the numeral 20, having a bed 21. The sewing machine 20 has an attachment bar 22 to which pressure feet and other attachments are normally secured, and a reciprocating needle bar 23 to which a needle 24 (FIG. 4) is rigidly secured. The attachment, which is the subject of this invention, is designated generally by the numeral 30, and is rigidly secured to the attachment bar 22, as will be explained hereinafter.

Figure 2:
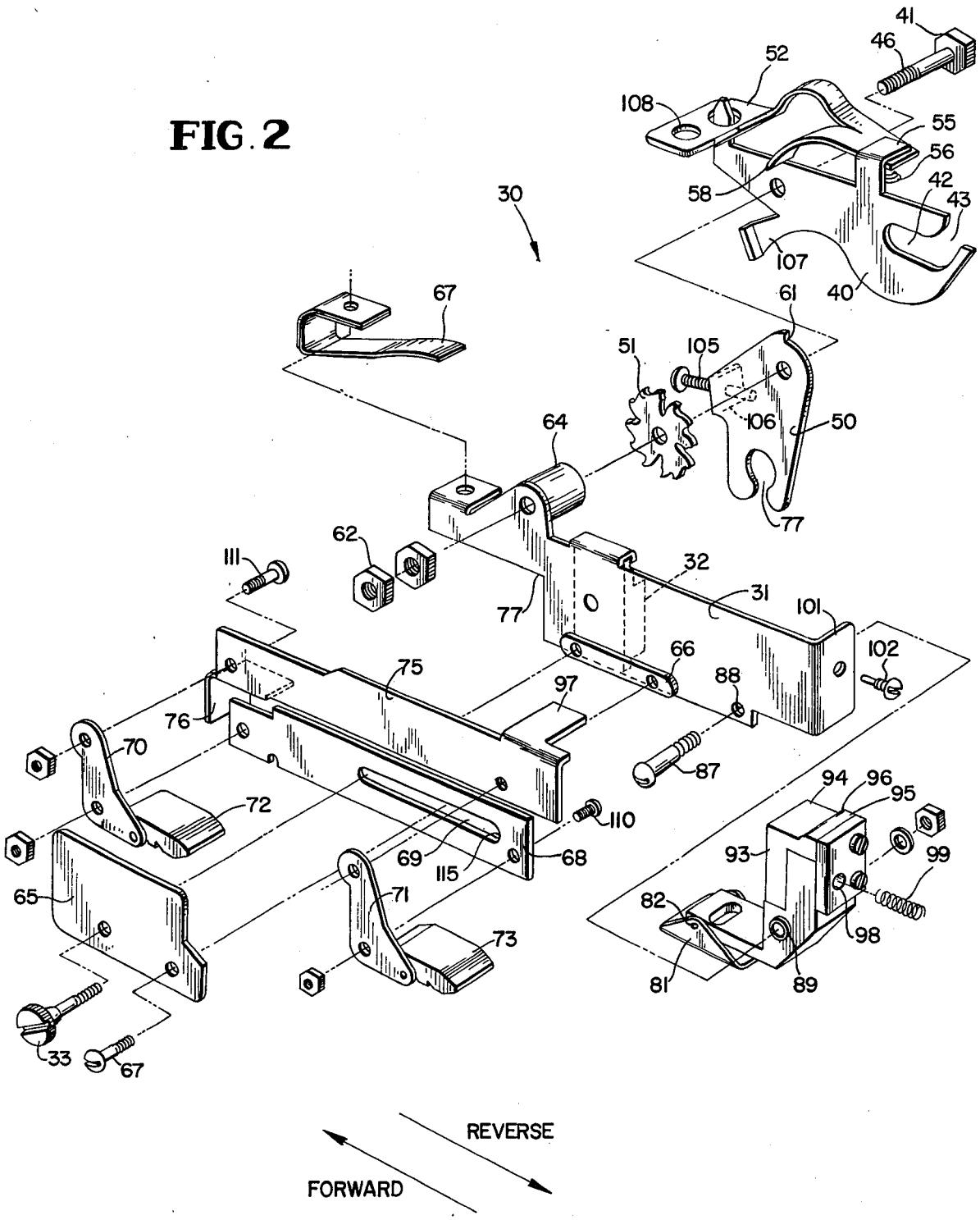
FIG. 2 is an exploded isometric view of the attachment of FIG. 1, as viewed from one side.
Figure 3:
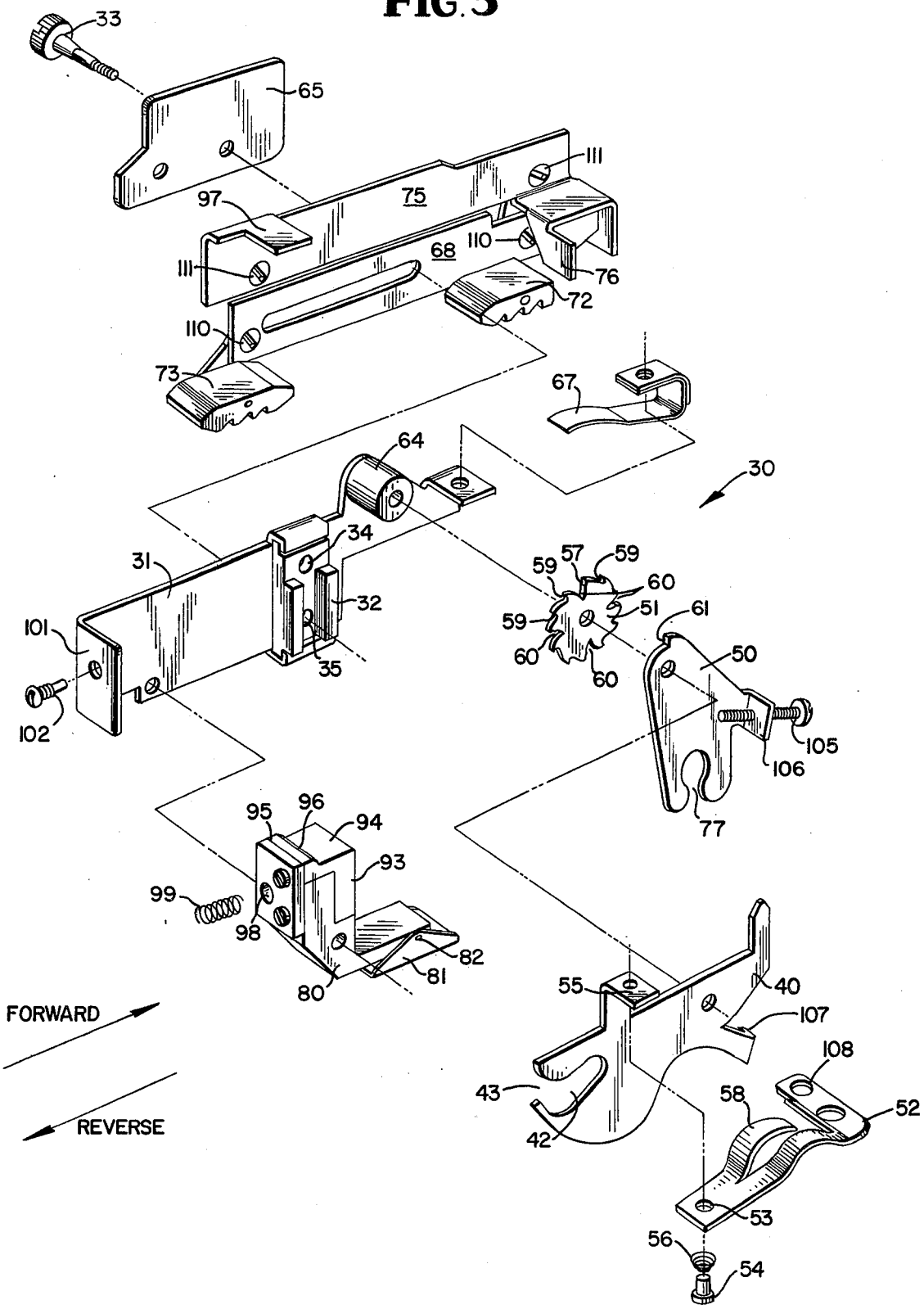
FIG. 3 is an exploded isometric view of the attachment of FIG. 1, as viewed from the opposite side.

Referring now to FIGS. 2 and 3, in which the attachment 30 is shown exploded and in prospective, the attachment consists of a main frame 31, which has an interchangeable mounting block 32 and 32 A thereon, by means of a channel and hip arrangement, through which a screw 33 is received. The attachment bar 22 is received in a slot 34 in the mounting block 32, and the screw 33 passes through a hole 35 in the mounting block and threads into a threaded hole 36 in the attachment bar 22 (See FIGS. 6, 7 and 9 through 11). The frame 31 is, therefore, held in rigid relation, with respect to the sewing machine 20 and bed 21. The needle bar 23 reciprocates relative to the main frame 31, and the main frame 31 supports all of the movable elements of the attachment 30. By attaching the main frame 31 to the attachment bar 22 with the screw 33, the main frame 31 and, thus, the attachment 30 may be readily secured to most all existing sewing machines, which utilize an attachment bar, such as attachment bar 22.

Motion is transmitted to the various elements of the attachment 30 by a first lever 40 pivoted on the shank of a screw 41 that is secured to the main frame 31. As is seen in FIGS. 4 through 10, the first lever 40 has an elongated slot 42 therein, which has an opening 43. A lug 44 projecting from the needle bar 23 is received in the slot 42. As the needle bar 23 reciprocates up and down, in the direction of arrow 45, the first lever 40 oscillates about a smooth shank portion 46 of the pivot screw 41. The opening 43 of the slot 42 allows the attachment 30 to be quickly mounted on the sewing machine 20, because the lug 44 may be slid through the opening, while the mounting block is adjusted to the attachment bar 22.

Coaxially mounted with the first lever 40 is a second lever 50 and a ratchet 51. The first lever 40, the second lever 50 and the ratchet 51 are each freely rotatable upon the smooth shank portion 46 of the pivot screw 41. The second lever 50 transmits motion to the fabric reversing mechanism, while the ratchet 51 programs the coordination between the second lever 50 and the first lever 40. Attached to the first lever 40 is a pawl 52. The pawl 52 has a hole 53 therein through which passes a rivet 54, which holds the pawl to a tab 55 projecting perpendicularly to the plane of lever 40. A spring 56 is disposed between the rivet 54 and the pawl 52, in order to urge the pawl 52 downwardly to engage the ratchet teeth 59 of ratchet 51, as shown in FIG. 4. The pawl 52 has a tang 58 projecting downwardly therefrom, which engages the teeth 59 of ratchet 51. Adjacent every third tooth 59 is a deep slot 60, into which the tang 58 drops every third oscillation of the first lever 40. When this happens, the tang 58 will engage a shoulder 61 on the second lever 50 and operate the second lever which, in turn, actuates the reversing mechanism. This operation will be explained in more detail hereinafter with the sequential discussion of FIGS. 4 through 11.

A spacer 64 is coaxially mounted between the main frame 31 and the ratchet 50. The spacer 64 serves to position the first lever 40 and second lever 50 on the opposite side of the attachment bar 22 and needle bar 23 from the main frame 31. A pair of nuts 62 retain the pivot screw 41 and the afore-described assembly in place on the main frame 31.

Mounted on the main frame 31 is a secondary frame 65, which is secured to a track 66 by a screw 67. There is a space between the secondary frame 65 and the main frame 31, which is equal to the thickness of the track 66. In the space, a slider 68 is mounted and receives the track 66 in a slot 69. The track 66 limits motion of the slider 68 to reciprocal motion.

A pair of triangular links 70 and 71 are pivoted to each end of the slider 68. A reverse feed dog 72 is mounted at one end of the link 70, while a reverse feed dog 73 is mounted at one end of the link 71.

A second slider 75 is mounted coplanar with and above the first slider 68. The links 70 and 71 are pivoted to opposite ends of the slider 75 to form a parallelogram type linkage with the slider 75 and the slider 68 moving parallel to one another, and the links 70 and 71 moving parallel with one another. The slider 75 has a lug 76 projecting downwardly therefrom and outwardly through a cutout 77 in the main frame 31. The lug 76 is engaged by a slot 77 in the second lever 50. As will be explained hereinafter, when the second lever 50 pivots, the lug 76 in the slot 77 will reciprocate the second slider 75.

The final element, attached to the main frame 31, is a foot lever 80. The foot lever 80 has a foot 81 pivoted thereto on axis 82. The foot 81 engages the fabric being sewed and urges the fabric into contact with lower feed dogs 84 and 85, positioned beneath the bed 21 (see FIG. 4). The foot lever 80 is pivoted on the main frame 31 by a screw 87, which passes through a hole 88 in the main frame and a bore 89 in the foot lever.

A teflon block 93 is positioned over the top of the foot lever 80, and has a first surface 94 and a second surface 95, which is positioned slightly above the first surface and connected thereto by a shoulder 96. As is seen in FIGS. 4, 5, 7 and 8, a lug 97 on the slider 75 clears the first surface 94 of the block 93, this allows spring 99 to "bias" the foot lever 80 and foot 81 into engagement with the fabric by holding the foot lever 80 in a first position. As is seen in FIG. 9, when the lug 97 slides to the left and engages the shoulder 96, it cams the foot lever 81 out of engagement with the fabric. As is seen in FIG. 11, when the lug 97 engages the upper surface 95, it holds the foot lever out of engagement with the fabric. In order to "bias", the foot lever 80, a coil spring 99 is seated in a bore 98 of the foot lever, and is compressed against the flange 101 of the main frame 31. A screw 102 holds the spring 99 in place.

The attachment 30 has two adjustment features. One is an adjusting screw 105, which is positioned within a lug 106 on the second lever 50. The screw 105 is screwed in and out to adjust the distance between a finger 107 projecting from the first lever 40, so that when the first lever 40 is moved down, the screw 105 is engaged to retract the feet 72 and 73, as will be explained hereinafter The second adjustment is an extra hole 108 in the pawl 52, which allows the pawl 52 to be seated in an inactive position, when pivoted about the pivot 54, so that the tang 58 will not engage ratchet wheel 51. When the attachment 30 is in the inactive condition, a conventional single stitch will be formed.

OPERATION OF THE ATTACHMENT

Figure 5:
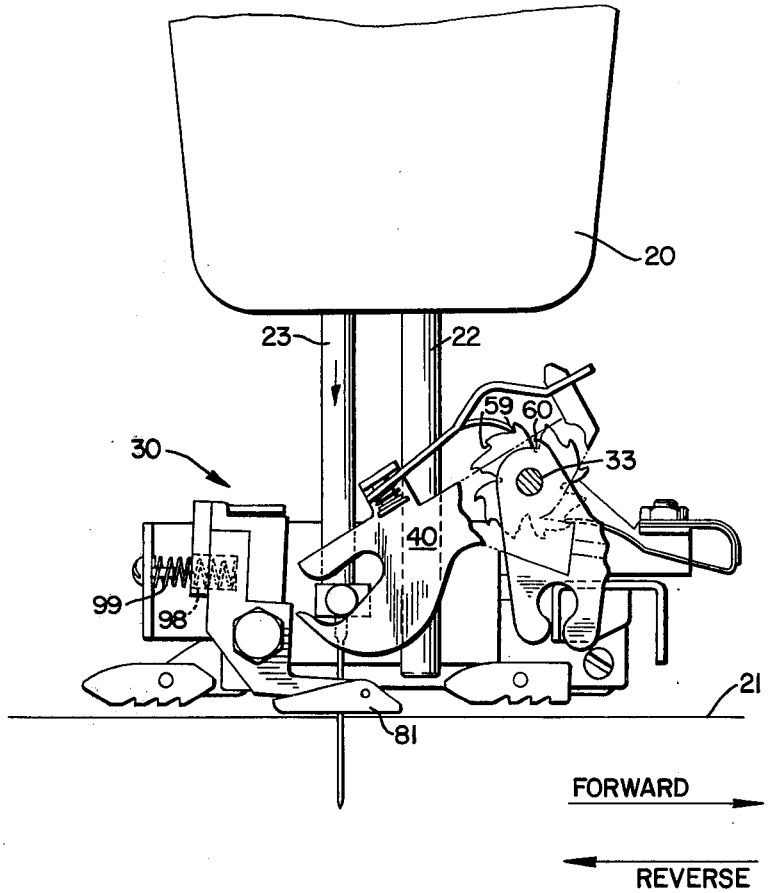
FIG. 5 is a view, similar to FIG. 4, but showing portions of the attachment broken away to illustrate the position of various parts of the attachment.
Figure 5A:
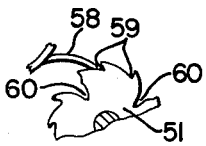
Figure 6:
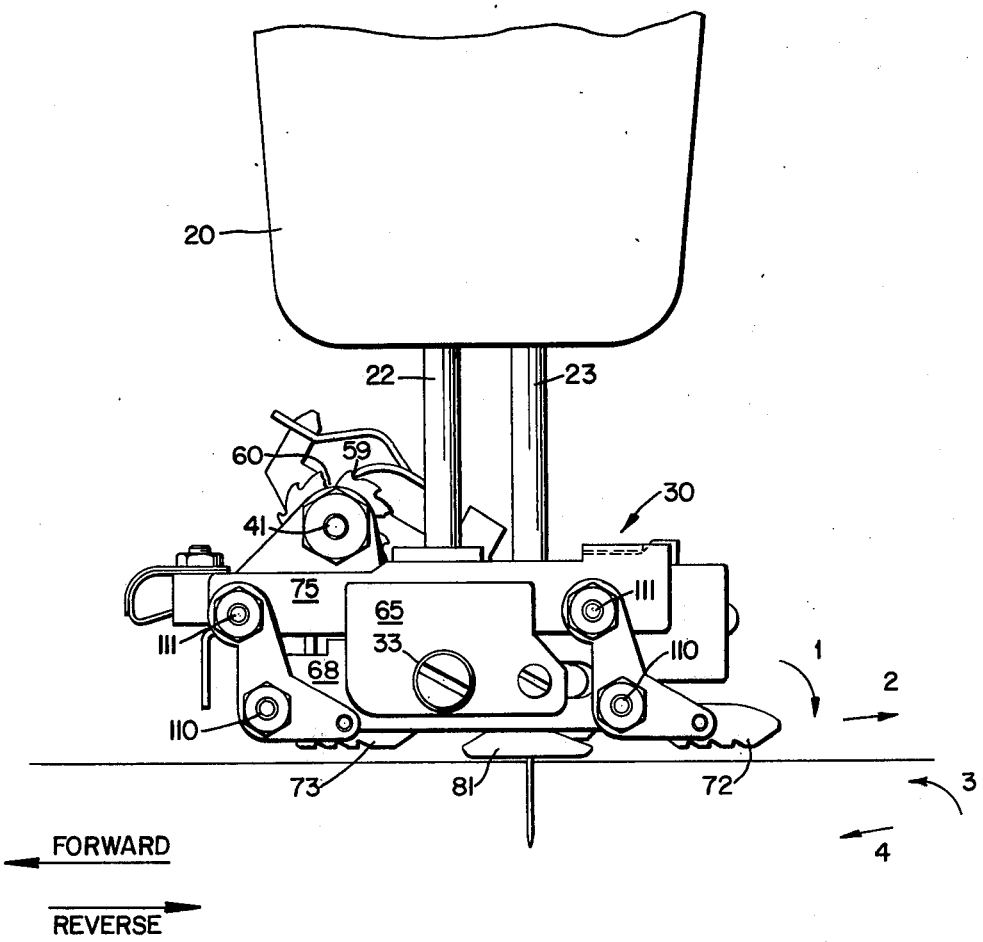
FIG. 6 is a view of the other side of the attachment, while in the operative position of FIGS. 4 and 5.

Referring now to FIGS. 4 through 11, the operation of the attachment 30 will now be set forth. In FIGS. 4, 5 and 6, the attachment 30 is shown in the condition just after reversing the fabric. As is seen in FIGS. 4, 5 and 6, the needle 24 is projecting through the fabric, the foot 81 is pressing the fabric against the feed dogs 84 and 85, and the feed dogs 84 and 85 are beginning their return stroke. The tang 58 is engaging the tooth 59 just after being removed from the deep slot 60. The fabric will, therefore, undergo two advances before the tang 58 drops into the next deep slot 60.

Referring now to FIG. 7, as the needle bar 23 rises, the needle 24 is removed from the fabric and the bottom feed dogs 84 and 85 engage the underside of the fabric, while the fabric is being pressed downwardly by the foot 81. This moves the fabric to the right. As the needle bar 23 rises, the lug 44 in the slot 42 of the first lever 40 pivots the first lever 40 about pivot 41. The tang 58, which is carried by the pawl 52 mounted on the lever 40, pushes against the tooth 59, so as to rotate the ratchet wheel 51. As the ratchet wheel 51 rotates, the detent spring 67 snaps in front of a tooth 59 to prevent the ratchet wheel from rotating in the counterclockwise direction.

The needle bar 23 then starts down toward the position shown in FIG. 5. When this happens, the first lever 40 rotates about the pivot 41 in the counterclockwise direction, carrying the tang 58 to the next tooth 59 spaced counterclockwise from the tooth engaged, as shown in FIG. 7. Since the ratchet wheel 51 is engaged by detent spring 67, it will not rotate in the counterclockwise direction, but will be held stationary.

The FIG. 5 condition now exists, except that the tang 58 is abutting the next successive tooth 59, as is shown in FIG. *5a*, which is one tooth before the deep slot 60. Since the needle 24 has now reentered the fabric, a complete stitch has been made. Upon advancing from the FIG. *5a* condition to the FIG. *7a* condition, the ratchet 51 rotates and is indexed, so that upon the next downward stroke of the needle bar 23, the first lever 40 will rotate in the counterclockwise direction, and the tang 58 will drop into the deep slot 60. When the needle 24 again penetrates the fabric, a second stitch will be formed, so that there will be two consecutive stitches and the fabric would have been advanced two-stitch lengths by the dogs 84 and 85.

When the tang 58 has dropped into the deep slot 60, the attachment 30 will now operate to reverse the direction of fabric feed, upon the next upstroke of the needle bar 23. This phenomenon is shown in FIGS. 8 through 11. Generally, in viewing FIGS. 8 through 11, in order to reverse the direction of fabric feed, it is necessary to first have the needle 24 and the foot 81 disengage from the fabric, so that the fabric is not restrained by the needle, and so that the fabric is not pushed into engagement with the bottom feed dogs 84 and 85. It is then necessary to move the reverse feed dogs or feet 72 and 73 to the left, while both the needle 24 and foot 81 are disengaged.

Referring now to FIG. 8, as the needle bar 23 rises, the lug 44 pivots the first lever 40 in the clockwise direction. Since the tang 58 is in the deep slot 60, it will abut a shoulder 61 on the second lever 50, and rotate the second lever in the clockwise direction about pivot screw 41. As the second lever 50 rotates about pivot screw 41, the lug 76, which is received in the slot 77 of the second lever, is engaged and pushed to the left, FIG. 10. This causes the slider 75, shown in phantom in FIG. 10, from which the lug 76 projects, to move to the left, as shown in FIG. 10.

As the slider 75 moves to the left as shown in FIG. 9, the lug 97 engages shoulder 96 of the foot lever 80 and rotates the foot lever in the counterclockwise direction about the pivot screw 87. This lifts the foot 81 from the fabric, so that the fabric is not pressed against the bottom feed dogs 84 and 85, rendering the bottom feed dogs ineffective.

As the slider 75 moves to the left, it lowers the reverse feed dogs 72 and 73 from the FIG. 8 position to the FIG. 9 position. This is accomplished by rotating the links 70 and 71 about the axis formed with mounting screws 110, which pivotally mount the levers 70 and 71 on the lower slider 68 (see FIGS. 1, 3 and 6). As is, perhaps, best seen in FIGS. 1 and 6, the links 70 and 71 are secured to the upper slider 75 by screws 111, so that the links can pivot relative to the slider 75. As the slider 75 moves to the left, in FIG. 9, or to the right, in FIG. 6, which is looking at the attachment from the opposite direction, the links 70 are pivoted about screws 110 in the counterclockwise direction in FIG. 9, and the clockwise direction in FIG. 6, in order to lower the reverse feed dogs 72 and 73 onto the fabric.

Since the reverse feed dogs 72 and 73 must push the fabric in the direction shown by the arrows 112 in FIG. 10, it is necessary that the attachment 30 have structure to permit sliding motion, after the reverse feed dogs have been lowered onto the fabric. This is accomplished by the parallelogram type linkage composed of the sliders 68 and 75 and the links 70 and 71. When the reverse feed dogs 72 and 73 are lowered by rotating the links 70 and 71, the slider 68 is positioned to the right in FIG. 9, so that the track 66 is near the end 115 of the slot 69 (see FIG. 2). The slider 58 is retained by the friction between the slider and other portions of the mechanism in this position until the lug 97 rides over the block 94. As the lug 97 pushes against the shoulder 96 of the block 94 and cams the foot 81 out of engagement with the fabric, the slider 68 remains to the right in FIG. 9, while the reverse feed dogs 72 and 73 are lowered into contact with the fabric. Continued motion of the slider 75, under the urging of the second lever 50 results in the slider 68 moving to the left in FIG. 9 or to the right in FIGS. 1 and 6. This sliding movement of the slider 68 is readily seen in the difference between the position of the slider 68 in FIGS. 9 and 10. In FIG. 10, the slider 58 is shown projecting beyond the block 80, whereas in FIG. 9, the slider is not seen. Also, in FIG. 10, the second lever 50 is rotated more in the clockwise direction than in FIG. 9. Furthermore, in FIG. 10, the lug 97 is resting over the surface 95 of the block 94.

In FIG. 10, the needle bar 23 is at its topmost position and is ready to start its down stroke and reinsert the needle 24 through the fabric to make another stitch. The fabric has been reversed the length of one stitch, and it is necessary to reinsert the thread, in order to complete the stitch.

Referring now to FIG. 11, as the needle bar 23 starts down the second lever 40 rotates in the counterclockwise direction moving the lug 107 toward the screw 105. After the needle 24 has penetrated the fabric, and is moving toward the position in FIG. 4, the lug 107 engages the end of the screw 105 and rotates the second lever 50 in the counterclockwise direction, so as to move the lug 76 from the position shown in FIG. 11 to the position shown in FIG. 4. Since the lug 76 is attached to the slider 75, the slider 75 will be moved to the right, with respect to FIGS. 10 and 11 and to the left, with respect to FIGS. 1 and 6. As the slider 75 is moved to the right in FIG. 4, from the position of FIG. 11, and to the left direction in FIGS. 1, 2 and 6, the links 70 and 72 are pivoted about screws 110 in the counterclockwise direction, with respect to FIGS. 1 and 6, to lift the reverse feed dogs 72 and 73 from the fabric. While the reverse feed dogs 72 and 73 are being lifted from the fabric, the slider 68 starts moving to the left direction, when viewed in FIGS. 1, 2 and 6. After the reverse feed dogs 72 and 73 are at their uppermost position, the slider 75 continues in its movement to the left in FIGS. 1 and 6 pulling the slider 68 back to its inoperative position.

The final position of the slider 68 is determined by the adjustment screw 105. If the adjustment screw 105 is advanced more toward the lug 107, then the final position or the inoperative position of the second lever 50 will be further in the counterclockwise direction, so that the slider 75 and the slider 68 will be further to the left in FIG. 11 and further to the right in FIGS. 1 and 6.

Since the bottom feed dogs 84 and 85 project up from the base 21 of the sewing machine, it is desirable that the foot 81 accommodate this rise. This is accomplished by the spring 99 disposed between the foot lever 80 and the flange 101 on the main frame 31. The spring 99 urges the foot lever 80 to rotate in a counterclockwise direction, as seen in FIG. 2 about the pivot screw 87. When the bottom feed dogs 84 and 85 move upwardly, they bear against the fabric and, thus, the pressure foot 81 causing the foot lever 80 to pivot slightly in the clockwise direction, when viewed from the prospective of FIGS. 2 and 4, against the bias of the spring 99. As the bottom feed dogs drop down to start their return stroke, spring 99 urges the foot lever 80 in the clockwise direction against the fabric. Consequently, the foot lever 80 oscillates back and forth against the bias of the spring 99.

SUMMARY OF OPERATION

Generally, two stitches are made in the forward direction while the pressure foot 81 is urging the fabric against the bed 21 and, thus, against the bottom feed dogs 84 and 85. During these two stitches, the bottom feed dogs 84 and 85 go through two cycles and the needle 24 is inserted into the fabric three times. At the third insertion of the needle 24, in other words, when the needle bar 23 is moving in the downward direction, a tang 58 drops into the deep slot 60 (see FIG. 8). As the needle bar 23 rises, as is shown in FIG. 8, the first lever 40 causes the second lever 50 to rotate in the clockwise direction, because the tang 58 is positioned in the deep slot 60. As the second lever 50 rotates, it pushes the lug 76 on the slider 75 to the left, as shown in FIG. 8, thus, causing the lug 97 to cam the foot lever 80 in the counterclockwise direction, as shown in FIG. 9. As the foot lever 80 rotates in the counterclockwise direction, it lifts the pressure foot 80 from engagement with the fabric.

As the Frame 75 moves to the left, as shown in FIG. 9, it also rotates the reverse feed dogs 72 and 73 downward in the counterclockwise direction by rotating the links 70 and 71 counterclockwise, as shown in FIG. 5, or as shown in FIGS. 1 and 6 clockwise. By rotating the feed dogs downward in the clockwise direction, as shown in FIG. 9, it is possible to accommodate a fabric of any given thickness. In addition, the feed dogs 72 and 73 are pivoted to the links 70 and 71, so that the reverse feed dogs will press flat against the fabric.

After the reverse feed dogs 72 and 73 engage the fabric, the slider 75 continues to move to the left from the position of FIG. 9 to the position of FIG. 10. This movement to the left of the slider 75 carries the slider 68 to the left, as seen in FIG. 10, because the two sliders are connected by a parallelogram linkage effected by the links 70 and 71, which are restrained from rotation, because the upper feed dogs 72 and 73 are pushing against the fabric. In this way, the reverse feed of the fabric is effected.

The needle 24 then again passes through the fabric to effect the reverse stitch. As the needle 24 is withdrawn from the fabric, the foot 81 is held spaced from the fabric, so that the feed dogs 84 and 85 will not advance the fabric, while the reverse feed dogs 72 and 73 are held in engagement with the fabric. After the needle 24 reaches the position shown in FIG. 11, the needle bar 23 starts downward rotating the first lever 40, so that the flange 107 hits the adjustment screw, 105, which causes the second lever 50 to rotate in the counterclockwise direction. The second lever 50, therefore, rotates from the position in FIG. 11 to the position shown in FIG. 4, 5 and 6. As the second lever 50 rotates to the position of FIGS. 4, 5, and 6, it retracts the reverse feed dogs 72 and 73 away from the fabric and moves the lug 97 slightly in clear of surface 94 and 96 of the block 93, to allow for unrestricted pressure on dogs 84 and 85. Movement of the lug 97 from the position shown in FIG. 11 to the position shown in FIG. 4, allows the spring 99 to rotate the foot lever 80, so that the pressure foot 81 is back in engagement with the fabric.

The cycle then repeats itself with two stitches taken with the cycle of FIGS. 4, 7 and 8 for advancing the cloth the length of two stitches and one stitch taken with the cycle represented by FIGS. 9, 10 and 11. In this way, an overlapped stitch suitable for fabrics, such as double-knit fabrics, is created.

The foregoing example is merely indicative of one embodiment of the invention, and the invention is only to be limited by the following appended claims:

What is claimed is:

1. An attachment for use with a sewing machine, wherein the sewing machine has a reciprocating needle member with an accessory attaching member adjacent the needle, and wherein the sewing machine has at least one intermittently engaged feed dog disposed opposite said needle for advancing fabric being sewn, said attachment comprising:

means for mounting the attachment on the accessory attaching member;

a first movable member on the attachment;

means for coupling the first movable member to the needle to cycle, while the needle reciprocates;

reversing means for engaging the fabric from the top and for reversing the direction of advance of the fabric; and means disposed between said movable member and said reversing means for activating said reversing means after two cycles of said movable member to thereby form three overlapped stitches for each advance of one stitch length.

2. An attachment for use with a sewing machine, wherein the sewing machine has a reciprocating needle member with an accessory attaching member adjacent the needle, and wherein the the sewing machine has at least one intermittently engaged bottom feed dog disposed opposite said needle for advancing fabric being sewn, said attachment comprising:

a mounting member;

means for rigidly securing said mounting member to said accessory attaching member;

a first lever;

means for pivoting said first lever on said mounting member;

means for attaching said first lever to the reciprocating needle member to oscillate said first lever about said pivoting means, and to thereby cycle said first lever, as said needle member reciprocates;

pawl means mounted on said first lever means for movement with said first lever means and displacement, with respect to said first lever means;

ratchet means engaged and indexed by said pawl means to advance one step with each cycle of said first lever;

means for altering the displacement of said pawl means relative to said ratchet means after each two-step advance of said ratchet means;

second lever means pivotally mounted on said mounting member for rotation relative thereto between an inoperative condition and an operative condition;

shoulder means on said second lever means for engagement by said pawl, when the displacement of said pawl is altered by said ratchet means, wherein said second lever is rotated in a first direction by said pawl, during the first half of every third cycle of said first lever;

foot means mounted on said mounting member for urging the fabric into engagement with said bottom feed dog;

reverse feed dog means mounted on said mounting member for engaging the top of the fabric and for reversing the advance of said fabric;

means actuated by said second lever to disengage said foot means from said fabric and to operate said reverse feed dog means to reverse feed said fabric; and means for rotating the second lever in the opposite direction during the second half of the third cycle to reengage said foot means with said fabric and to disengage said reverse feed dog means from said fabric.

3. The attachment of claim 2, wherein the ratchet means is a ratchet wheel having peripheral teeth with shoulders, which are engaged by a spring means to limit rotation of the wheel in one direction, and wherein said means for altering displacement of said pawl means are relatively deep slots positioned in front of every third tooth, which allow said pawl means to engage said shoulder means on said second lever.

4. The attachment of claim 3, further including means for coaxially mounting said first lever, said second lever and said ratchet wheel on said mounting member.

5. The attachment of claim 4, further including means for pivotally mounting said pawl means on said first lever.

6. The attachment of claim 5, further including spring means for urging said pawl means into engagement with said ratchet wheel.

7. The attachment of claim 2, further including spring means for urging said pawl means into engagement with said ratchet means.

8. The attachment of claim 4, wherein said means for rotating the second lever in the opposite direction during the second half of the third cycle includes a pair of surfaces, one of which is on the first lever, and the other of which is on the second lever, wherein said surfaces engage, when the first lever reverses direction during oscillation, so that the first lever pushes the second lever to the inoperative condition.

9. The attachment of claim 8, wherein there is a gap between the surfaces, when the second lever is in the inoperative condition, and the first lever is at the beginning of a cycle, wherein the gap is adjustable in length and determines the position of the second lever, when the second lever is in the inoperative condition.

10. The attachment of claim 2, further including foot link means for pivoting said foot means on said mounting means and spring means engaging said link means to urge said foot means into engagement with the fabric.

11. The attachment of claim 2, wherein the reverse feed dog means includes at least one feed dog disposed downstream of said foot means in the direction of fabric advance, wherein said feed dog is mounted on a first pivoted link.

12. The attachment of claim 11, wherein the reverse feed dog means includes a second feed dog disposed upstream of said foot means in the direction of fabric advance, wherein said second feed dog is mounted on a pivoted second link.

13. The attachment of claim 12, wherein the first and second pivoted links are each pivoted intermediate the ends thereof to a first slider, which is mounted for sliding movement on said mounting member, and are pivoted at one end thereof to a second slider mounted for sliding movement on said mounting member, wherein said first and second sliders combine with said links to form a parallelogram linkage, which rotates said links to engage the reverse feed dogs with the fabric, and which slides to cause the reverse feed dogs to reverse feed the fabric, said attachment further including a connection between said second lever and said second slider for advancing said second slider to lower said reverse feed dogs upon rotation of said second lever during the first half of the third cycle.

14. The attachment of claim 13, further including foot link means for pivoting said foot means on said mounting means and spring means engaging said link means to urge said foot means into engagement with the fabric.

15. The attachment of claim 14, wherein said second slider has lug thereon which engages said foot link means to rotate said foot link means, when said second slider advances during the first half of the third cycle, so that said foot is disengaged from the fabric.

16. The attachment of claim 15, wherein the links pivoting the reverse feed dogs rotate the feed dogs in a direction generally opposite the direction of fabric advance with respect to the top of the fabric, so as to accommodate readily fabrics of different thicknesses.

17. The attachment of claim 13, wherein the links pivoting the reverse feed dogs rotate the feed dogs in a direction generally opposite the direction of fabric advance with respect to the top of the fabric, so as to accommodate readily fabrics of different thicknesses.

* * * * *